United States Patent [19]

Bähker et al.

[11] 4,087,067

[45] May 2, 1978

[54] TRAIN PROTECTION AND CONTROL SYSTEM

[75] Inventors: Friedrich Bähker, Brunswick; Ernst Jürgen Köhler, Brunswick, Veltenhof, both of Germany

[73] Assignee: Siemens Aktiengesellschaft, Berlin & Munich, Germany

[21] Appl. No.: 805,599

[22] Filed: Jun. 10, 1977

[30] Foreign Application Priority Data

Jun. 28, 1976 Germany ..... 2628942

[51] Int. Cl.[2] ..... B61L 3/12

[52] U.S. Cl. ..... 246/167 R; 246/187 B; 325/37

[58] Field of Search ..... 246/34 R, 34 CT, 167 R, 246/187 B, 4, 5; 179/15 BP; 325/37, 51, 64; 343/225, 226; 340/146.1 BA

[56] References Cited

U.S. PATENT DOCUMENTS

| | | | |
|---|---|---|---|
| 3,639,755 | 2/1972 | Wrege | 246/187 B |
| 3,766,523 | 10/1973 | Brocker | 325/64 |

*Primary Examiner*—Trygve M. Blix

*Assistant Examiner*—Reinhard J. Eisenzopf

*Attorney, Agent, or Firm*—Hill, Gross, Simpson, Van Santen, Steadman, Chiara & Simpson

[57] ABSTRACT

A train safety and control system utilizing at least one transmitter disposed at the railway right-of-way for the transmission of orders necessary for train traffic control and for the wireless exchange of general information between a track control center and trains moving in the associated right-of-way section, with a data processing installation being provided at the track control center for the cyclical determination of orders in the form of dynamic signals, in which the operational availability of the data processing system is monitored at the track control center, whereby at a predetermined operational readiness of the data process system a pilot sound generator is continuously activated, whose signals are conducted over the same transmission path of the transmitter as the orders for the traction vehicles, a switching device being provided in the vehicle responsive in dependence upon the presence of a received pilot sound signal for controlling the conduction of received control orders to responsive control apparatus on such vehicle.

5 Claims, 2 Drawing Figures

TRAIN PROTECTION AND CONTROL SYSTEM

BACKGROUND OF THE INVENTION

The invention relates to a train protection and control system in which at least one transmitter is provided at the railway right-of-way for the transmission of orders necessary in controlling train traffic and for the wireless exchange of general information between a track control center and trains moving in the associated right-of-way section, with a data processing unit being disposed at the track control center and providing a cyclic determination of control orders.

Electrical train reporting systems have been employed in railroad systems, in which orders necessary for the control of the train operations are transmitted by radio. In some installations the exchange of information between the train and right-of-way takes place linearly and in order to determine the location of the trains and for an exchange of information between such trains and a track control center, a line is placed along the right-of-way which is permanently fed with an AC voltage from the track control center, over respective marking points. Such line comprises a pair of unshielded conductors which are crossed at regular intervals whereby they change their position along the track. The crossing points thus formed can be "identified electrically" from the trains by means of inductively coupled receiving coils, the location of the train being determined by counting the respective crossing points.

The corresponding counting result, or intermediate results, can be reported over the line to the track control center, in order to determine additional control orders necessary for proper train movement. Such control orders are determined cyclically at the track control center by a data processing unit and thus regularly issued over the line and received on the trains by means of receiving coils inductively coupled with such line. The transmission of data in such cases is accomplished in accordance with the known principle of holding current. The orders issued by the track control center for reception and evaluation on board the rail vehicles are so designed that even a very short interruption in the transmission of data is identified as a defect and will result, for example, in a positive braking operation. This arrangement insures that a train in motion which is controlled by such a system involving linear train control, can be informed at a given time from the track control center, about changes in operation conditions. This only insures that limited operating orders can be transmitted with certainty to the trains. In other words, it is insured that the installations protecting the train traffic will have access to the moving trains at all times, even with linear exchange of information between the trains and the track control center.

While the use of avilable radio channels for the transmission of the necessary traffic control orders from a control center to the moving trains without the use of a line, the above-described principle of holding current is not feasible as the known train radio channels occasionally exhibit so-called transmission gaps resulting from atmospheric disturbances or unfavorable topography, whereby the transmission of orders to the trains is interrupted or even impossible. However, the density of information of stationary or variable data of a track section is so low that the low volume of information of the available railroad radio channels is adequate over and above train protection. However, it will be noted in this connection that the known railroad radio channels, i.e., the transmitters along the right of way and the receiving installations on board the trains will be used to a large extent for two-way communication. As a result, orders to be transmitted for train traffic control to the traction vehicles cannot be transmitted continuously, but rather only when a change in orders is involved. In the interim, the railroad radio channels are available for operational functions such as two-way radio communication.

With such an economical utilization of the available railway radio channels, no assurance exists, without problems, that in the event of a change of the operational conditions, especially in the event of a restriction, that the affected train can be informed without delay, as it is not known whether the entire transmission system is in a state of operational readiness for transmission of the required order.

Consequently, the invention is directed to the problem of so supplementing an installation of the type initially described that the radio type control will be effected in a manner similar to a holding current operation and which may be accomplished with a low rate of data for the control of the train traffic, whereby the operational functions involved in the train radio traffic control will not be impeded even though the operation does not actually involve a holding current.

SUMMARY OF THE INVENTION

The problem is solved in accordance with the invention by the provision at the track control center of testing means for monitoring the operational availability of the data processing unit, which at a predetermined operational readiness thereof, continuously operatively actuates a pilot sound generator whose signals are conducted over the same transmission path of the transmitter as the orders for the traction vehicles, with the issuance of orders to control means on board the vehicle being achieved by means of separate switching means, operative in response to the reception of the pilot sound signal.

In the event of failure of the pilot sound signal, and in the absence of a subordinate train protective system, the necessary operations will be again performed in accordance with visual signals which are present, or in accordance with an emergency signalling system.

In the event an additional simple train protection system is also present, supplementing the radio-line train transmission secured by the pilot sound signal, generally, in the event of a failure of the pilot sound signal, restricting orders of the additional train protection system become effective and take over the safety function for the train traffic. However, in some applications, the control system on board the traction vehicle may be so designed that in the event of a failure of the pilot sound signal a positive braking will be effected.

The invention has the important advantage that the railway radio channels available for operational purposes can be so utilized, in a surprising manner, that they may be additionally employed for train control without, overloading the available channels by too frequent transmission of orders, for example, in correspondence to operative utilizing the known principle of holding current, that an undesirable limitation of two-way communication traffic would become necessary.

The orders required for train traffic can be determined at the track control center in view of the necessary data required in various ways. Normally a data processing unit or system is provided which effects a cyclical determination of the desired orders. In this connection, in an advantageous embodiment of the invention, the testing means is designed to monitor the issuance of dynamic signals from the data processing unit, in which case such means may be designed in the form of a comparator which, in combination with a timing circuit, monitors the cyclical arrival of a symbol provided at the determination of each processing cycle of the data processing unit. This arrangement makes it possible in a very advantageous manner, to disconnect the pilot sound signal promptly upon a disclosure of an error, and thus to signal a train operated in the associated section of right-of-way that at a given time it cannot depend on a control order transmitted by radio.

Taking into consideration the fact that the radio transmission between the transmitter and the trains may be interrupted for very short periods of time due to atmospheric interferences or disturbances caused by the nature of the terrain and considering the fact that trains, operating in the section of right-of-way involved, may be traveling at widely differing speeds, it is advantageous to provide, on the traction vehicles an intermediate memory for the pilot sound signal at whose reset input two monitoring devices are connected which, following travel over a predetermined section of right-of-way, or after a predetermined interval of time, will issue a reset signal in the absence of a pilot sound signal.

By means of this arrangement, in accordance with the invention, interferences in transmission of short duration will not be evaluated as such unless they exceed a predetermined length of time.

BRIEF DESCRIPTION OF THE DRAWINGS

In the drawings wherein like reference characters indicate like or corresponding parts.

DETAILED DESCRIPTION OF THE INVENTION

Figure 1:
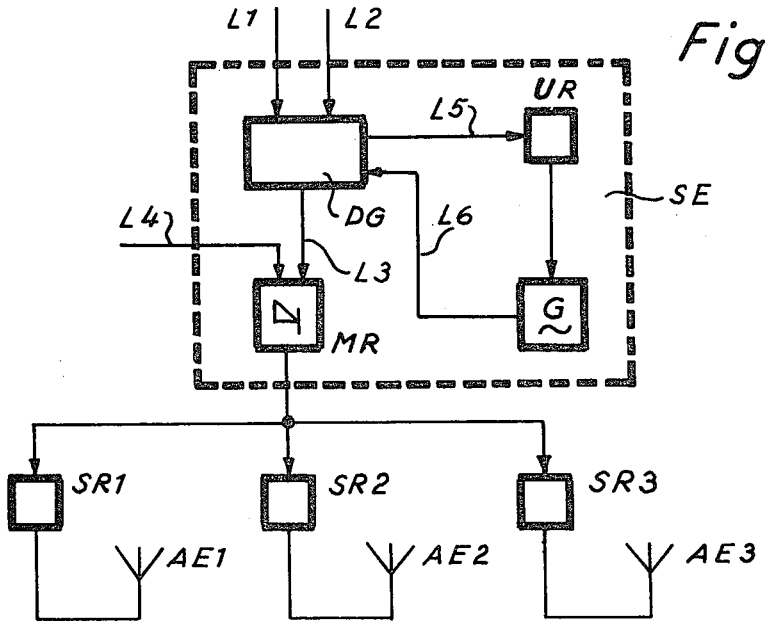
FIG. 1 is a schematic circuit diagram illustrating an installation disposed along the right-of-way for radio-line train control, employing a pilot sound signal for monitoring purposes.

The block diagram according to FIG. 1, illustrates, in simplified form, details of a right-of-way component of a train protection and control system. Reports are received at a track control center SE over lines L1, L2, which reports are processed in a data processing installation DG, forming a part of the track control center, with such processing preferably being cyclical in the formation of orders necessary for the train traffic. Such orders are conducted over a line L3 to a modulator MR, the output of which is illustrated as being connected to several transmitter amplifiers SR1, SR2, and SR3 which in turn are connected to and supply cooperable antennas AE1, AE2 and AE3. It is assumed in this embodiment that the track section, which is to be supplied with the operational information and orders from the track control center SE, is so large that a single transmitter is inadequate but that the track section can be adequately supplied by three transmission systems. Any other type of information not absolutely necessary for controlling the train traffic will be supplied to the modulator MR over line L4.

A monitor UR is provided at the data processing unit DG, which is operative to monitor the operational readiness or availability of the data processing unit DG. As previously mentioned, generally a data processing unit effecting a cyclical determination of orders, is preferable with a corresponding identification symbol being released at the end of each processing cycle. Such identification symbol is conducted over line L5 to the monitor UR which, in conjunction with an internal timing circuit, monitors the appearance of such an identification symbol. If the identification symbol is present in a regular manner, this fact is evaluated by the monitor as an indication that the data processing unit is in operation readiness and most importantly, is continuously operable to supply a new order necessary for the train traffic control.

A pilot sound or tone generator G is connected to the monitor UR with the latter being operative in the event a determination of operative readiness is established thereby to actuate the generator G, whereby a corresponding pilot sound signal is supplied over line L6 to the data processing unit. It is important, in this connection, that such signals are conducted over the same transmission path of the installation as the orders for the traction vehicles.

If, as will subsequently be apparent in connection with the description of FIG. 2, the issuance of an order on board a vehicle is conditional upon the simultaneous presence of the pilot sound signal, it is assured that not only is the operational readiness of the data processing unit DG monitored but, in addition, the transmission path for the necessary orders advantageously is monitored over line L3, the modulator MR and the transmission amplifiers SR1 to SR3, as well as the antenna AE1 to AE3.

Figure 2:
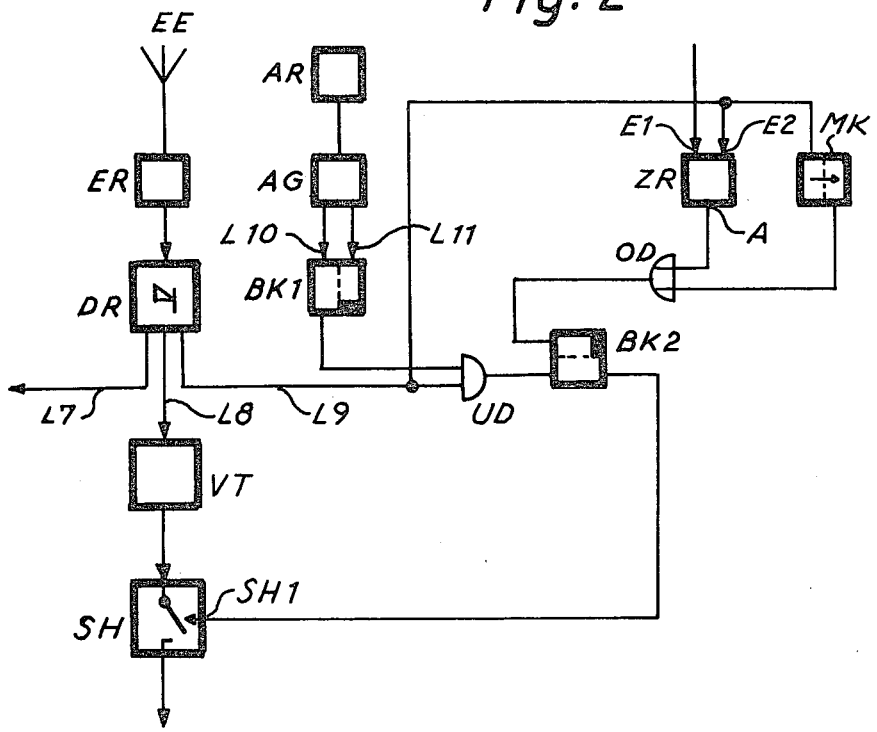
FIG. 2 illustrates a schematic circuit diagram of an installation provided on board a vehicle for the evaluation of the orders transmitted by radio and in particular the pilot sound signal.

The block circuit diagram illustrated in FIG. 2 includes the various components on board the traction vehicle for the reception and evaluation of the radio-transmitted signals, and also for the processing of information transmitted in the form of impulses. The signals transmitted wirelessly are received at the receiving antenna EE, and conducted to a receiver ER which controls a demodulator DR. General information by two-way radio communication is supplied over line L7 of the demodulator DR, while the orders necessary for train traffic control are supplied over a line L8 to a processing unit VT which may be of known construction. As details of the latter are not material to an explanation of the invention, such unit is illustrated merely in block form.

A switch SH is connected to the processing unit VT and, with a closing of the contact thereof, a drive order, for example, may be supplied over the switch for engine control, etc. It will be appreciated that additional switches may be provided for the supply of additional orders whereby orders, which may be simultaneously present, are separated from one another. The switches are controlled in dependence upon the transmitted pilot sound signal. The latter and/or a corresponding digital signal may be conducted over line L9 from the demodulator DR to an AND member UD, the output of which is connected to a counter ZR and to a monostable flip-flop stage MK. In addition, the output of a bistable flipflop stage BK1 is connected to the other input of the AND member UD, such flipflop stage being triggered into its operating position in response to an identification symbol transmitted in pulse-like form at the beginning of the radio-equipped track section. This is accomplished by means of a receiver AR for pulse-like information, which is provided on the traction vehicle, and which, for example, may comprise a receiving coil for inductive reception of pulse-like information from a short conductor loop at the beginning of a track section. A receiver AG, which includes an evaluation circuit, for the pulse-like data, is connected to the receiver AR with the connection identification symbol received being supplied over output line L10, for effecting a setting of the bistable flipflop stage BK1. The receiver AG controls over line L11, the bistable flipflop stage BK1, flipping it back into its basic position when the end of the radio-equipped track section is reached and a corresponding disconnection identification symbol is received.

A bistable flipflop stage BK2, the output of which is connected to the control input SH1 of the switch SH, is connected to the AND member UD, and functions as an intermediate memory for the pilot sound signal. While the bistable flipflop stage BK1 is primarily intended for storage of the connection identification symbol or signal, the second bistable flipflop BK2 is utilized to store a control identification signal for the switch SH when the bistable flipflop stage BK1 is set, and simultaneously therewith the pilot sound signal is present on the line L9. Upon setting of the bistable flipflop stage BK2, the contact in switch SH is closed.

The counter ZR is operative to monitor, in a track-dependent manner, the reception of the pilot sound signal, whereby failures of short duration in the pilot sound signal will not result in a resetting of the bistable flipflop stage BK2. The counter ZR has two inputs E1 and E2 and a single output A, which is connected, over an OR member OD, with the rest input of the bistable flipflop stage BK2. In operation, the counter ZR receives, over the input E1 impulses which have already been generated for other components (not illustrated) of the traction vehicle. The input E2 has blocking characteristics and by means of a pilot sound signal present thereon, the counter Z2 is maintained in its basic position, and/or after a short duration failure of the pilot sound signal is reset into its basic position. On the other hand, if the pilot sound signal remains absent for any length of time, following presetting of the counter ZR thereby, the latter upon reaching its terminal position, i.e., reaching its counting total, the counter will emit a signal at the output A, which resets the bistable flipflop stage BK2 and which, in turn, reopens the contact in the switch SH and thus a drive order predetermined by the processing unit VT is operatively disconnected, i.e., is not connected through to the device to be controlled thereby.

Monitoring of the pilot sound signal on board the traction vehicle merely by the counter ZR is, as a rule, by itself insufficient and in particular if the traction vehicle involves a very slow traveling speed, absence of a pilot sound signal is recognized only after a period of time of greater duration. Consequently, in addition to the track-dependent pilot sound monitoring by the counter ZR, another time-dependent monitoring is achieved by the provision of a monostable flipflop stage MK, the output of which is likewise connected over the OR member OD to the reset input of the bistable flipflop stage BK2. The monostable flipflop stage MK is supplied at its input with the pilot sound signal and may be designed, for example, as a re-triggerable flipflop stage. As a result, in the presence of a pilot sound at its input, it is in its unstable position in which no reset signal is transmitted to the bistable flipflop stage BK2. In the event of a failure in reception of the pilot sound signal, the monostable flipflop stage MK continues to remain in the unstable position for a predetermined interval of time, and if the disturbance of the transmission of the pilot sound is merely of a short duration, the monostable flipflop stage MK will not return to its stable position. However, if the abscence of the pilot sound signal exists during a prolonged period of time, the monostable flipflop stage MK will return to its stable position and the bistable flipflop stage BK will be reset into the indicated basic position.

Assuming that the track section is not equipped at its start and end with pulse-like sources of information, the embodiment illustrated in FIG. 2 can be further modified by directly connecting line L9 with the bistable flipflop stage BK2, in which case the receivers AR and AG, the bistable flipflop stage BK1 and the AND member UD may be omitted. It is also important in such an embodiment that irrespective of the transmission of orders for train control on board the traction vehicles, the operational readiness of the stationary components on board the train is also known, whereby the vehicular installations can rely on being informed of changes in the issuance of orders immediately by radio.

In the modification of the embodiment illustrated in FIG. 2 it is also possible to replace the bistable flipflop stage BK1 with a monostable flipflop stage, in which case the line L11 may be omitted. This arrangement has the advantage, from a signal-engineering standpoint, that the storage of the pilot sound signal can take place only for a predetermined time following the receiving of the connection identification signal.

Having thus described our invention it will be obvious that although various minor modifications might be suggested by those versed in the art, it should be understood that we wish to embody within the scope of the patent granted hereon all such modifications as reasonably and properly come within the scope of our contribution to the art.

We claim as our invention:

1. In a train safety and control installation having at least one transmitter disposed at the railway right-of-way for the transmission of orders necessary for train traffic control and for the wireless exchange of general information between a track control center and trains moving in the associated right-of-way section, with a data processing unit being provided at the track control center for the cyclical determination of orders, the combination of monitoring means at the track control center for monitoring the operational availability of the data processing unit, operative, at a predetermined operational readiness of the data processing unit to continuously activate a pilot sound generator whose signals are conducted over the same transmission path of the transmitter as the orders for the traction vehicles, receiving means on the vehicle and switching means cooperable therewith responsive to the presence of a received pilot sound signal for controlling the conduction of received control orders to responsive control means on the traction vehicle.

2. A system according to claim 1, wherein the monitoring means is operable to monitor the issuance of dynamic signals of the data processing unit.

3. A system according to claim 2, wherein the monitoring means operates as a comparator, monitoring, in combination with a timing circuit, the cyclical arrival of a symbol provided at the end of each processing cycle of the data processing unit.

4. A system according to claim 1, wherein an intermediate memory is provided on board the traction vehicle for the pilot sound signal, having a reset input to which two monitoring means are connected whereby after traversing a predetermined stretch of right-of-way, or after a predetermined time interval without the reception of a pilot sound, will supply a reset signal.

5. A system according to claim 1, wherein means are provided on board the traction vehicle, responsive to a received connection identification symbol transmitted separately over the track to the traction vehicle at the start of a track section for initiating evaluation of received pilot sound signals.

* * * * *